US007293596B2

(12) United States Patent
Nien

(10) Patent No.: US 7,293,596 B2
(45) Date of Patent: Nov. 13, 2007

(54) WINDOW BLIND STRUCTURE WITH MULTIPLE RODS AND BLINDS

(76) Inventor: Leslie Nien, No. 45-4, Fanpo St., Fuxing Shiang, Changhua County (TW)

( * ) Notice: Subject to any disclaimer, the term of this patent is extended or adjusted under 35 U.S.C. 154(b) by 370 days.

(21) Appl. No.: 11/082,695

(22) Filed: Mar. 18, 2005

(65) Prior Publication Data

US 2006/0169417 A1 Aug. 3, 2006

(30) Foreign Application Priority Data

Jan. 31, 2005 (TW) ..... 94201742 U

(51) Int. Cl.
*A47H 1/00* (2006.01)
*E06B 3/32* (2006.01)

(52) U.S. Cl. ..... 160/89; 160/108; 160/123

(58) Field of Classification Search ..... 160/84.04, 160/84.01, 84.05, 84.1, 89, 84.02, 83.1, 84.03, 160/84.06
See application file for complete search history.

(56) References Cited

U.S. PATENT DOCUMENTS

| | | | | |
|---|---|---|---|---|
| 6,722,414 | B2 * | 4/2004 | Nien | 160/123 |
| 6,860,064 | B2 * | 3/2005 | Bakalar | 49/127 |
| 2006/0021722 | A1 * | 2/2006 | Nien | 160/330 |
| 2006/0048901 | A1 * | 3/2006 | Nien | 160/84.01 |

* cited by examiner

*Primary Examiner*—George B. Nguyen
*Assistant Examiner*—Samuel S Lin
(74) *Attorney, Agent, or Firm*—Troxell Law Office, PLLC

(57) ABSTRACT

A window blind structure with multiple rods and blinds includes a plurality of support brackets, hook elements, head rails, and blind bodies wherein each support bracket is equipped with a fixing end with multiple fixing thru-holes disposed thereon for the secure engagement of locking screws therewith, and a suspending arm properly extending forwards from the fixing end thereof and provided with a plurality of equally-spaced retaining members each surrounded by a retaining space for the location of a matched hanging rod thereon. Both sides of the retaining member is defined by a set of left/right movement spaces to match with the hook element having a hanging portion to hook onto the hanging rod thereby and an inserting block with indented recesses disposed at the bottom end thereof to engage with an inserting groove disposed at the upper section of the head rail thereby. The head rail also has a receiving space with a stop flange disposed at the lower section thereof, and a connecting portion disposed at a predetermined section thereon for the attachment thereto of a connected portion of a blind body of different types. Thus, via the aforementioned structure, the blind bodies of different types can be freely moved and alternatively arranged at the hanging rods of the support brackets thereon as well as easily replaced with new ones according to the needs of a user, providing versatile and interesting variation as well as more flexible application of the present invention in practical use.

13 Claims, 6 Drawing Sheets

WINDOW BLIND STRUCTURE WITH MULTIPLE RODS AND BLINDS

BACKGROUND OF THE INVENTION

The present invention is related to a window blind structure with multiple rods and blinds, including a plurality of support brackets, hook elements, head rails, and blind bodies wherein the support brackets have a plurality of hanging rods properly located thereon so that, via the hook elements each having an inserting block to be accommodated into an inserting groove of the head rail and tightly secured thereon by a fixing member, the head rails are stably held in place on the hanging rods of the support brackets respectively, and the blind bodies of different types each attached to a connecting portion of the head rail can be freely moved and alternatively arranged at the hanging rods of the support brackets thereon as well as easily replaced with new ones according to the needs of a user, providing more versatile and interesting variation as well as more flexible and beautiful application of the present invention.

Please refer to FIG. 1. A conventional window blind 10 is simply made up of a head rail 11, and a blind body 12 with a lift cord 13 attached to the underside of the head rail 11 wherein the lift cord 13 is pulled to actuate the collecting or expanding operation of the blind body 12 thereby.

There are some drawbacks to the above conventional window blind 10. Most of all, the window blind 10, monotonously made with a single piece of blind body 12 mounted onto a single head rail 11, can't have the blind body 12 alternatively changed into new ones of different styles and patterns according to the needs of a user, which makes the conventional window blind 10 rather dull and inflexible in its appearance and application as well.

SUMMARY OF THE PRESENT INVENTION

It is, therefore, the primary purpose of the present invention to provide a window blind structure with multiple rods and blinds, including a plurality of support brackets, hook elements, head rails, and blind bodies wherein the blind bodies of different types each attached to a connecting portion of the head rail can be freely moved and alternatively arranged at hanging rods of the support brackets thereon as well as easily replaced with new ones according to the needs of a user, providing versatile and interesting variation as well as more flexible and beautiful application of the present invention in practical use.

It is, therefore, the second purpose of the present invention to provide a window blind structure with multiple rods and blinds wherein, via the hook elements each having an inserting block to be accommodated into an inserting groove of the head rail and tightly secured thereto by a fixing member, the head rails are stably held in place on the hanging rods of the support brackets respectively so that pull cords of the different blind bodies can be smoothly manipulated to control the collecting and expanding operation of the blind bodies thereby, facilitating a more convenient application of the present invention.

DETAILED DESCRIPTION OF THE PREFERRED EMBODIMENTS

Figure 1:
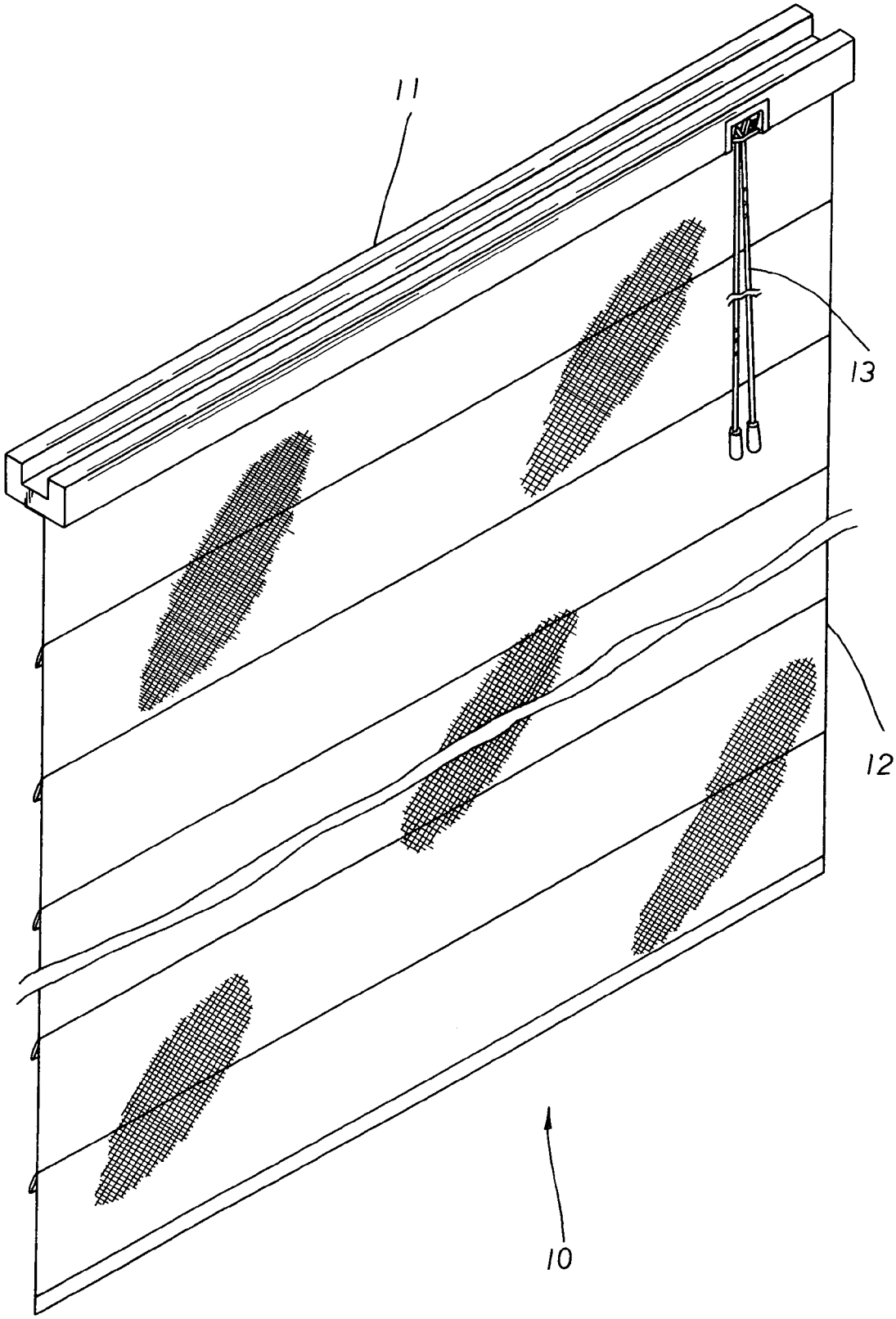
FIG. 1 PRIOR ART
FIG. 1 is a perspective view of a conventional window blind structure.
Figure 2:
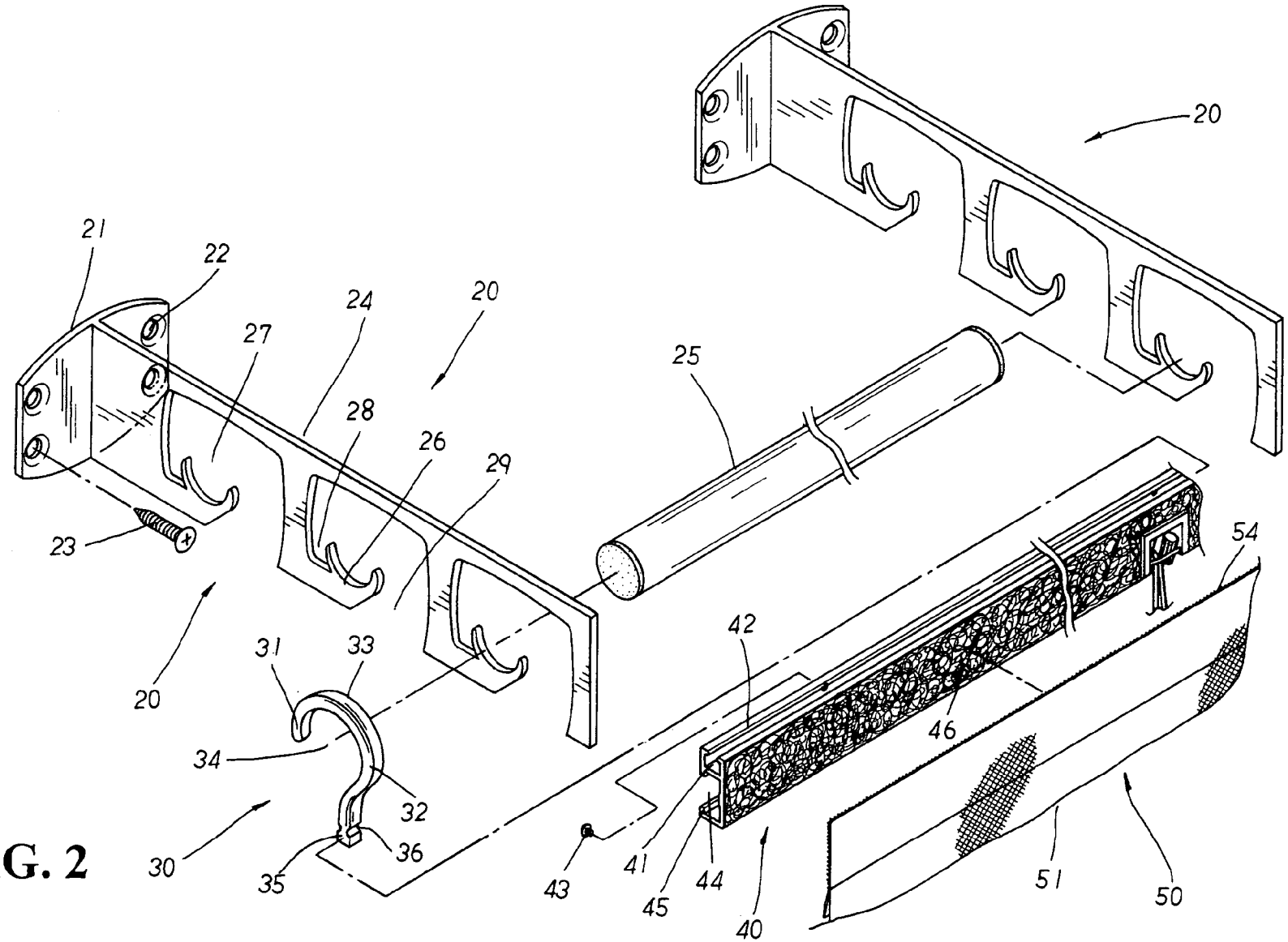
FIG. 2 is a partially exploded and perspective view of the present invention.
Figure 3:
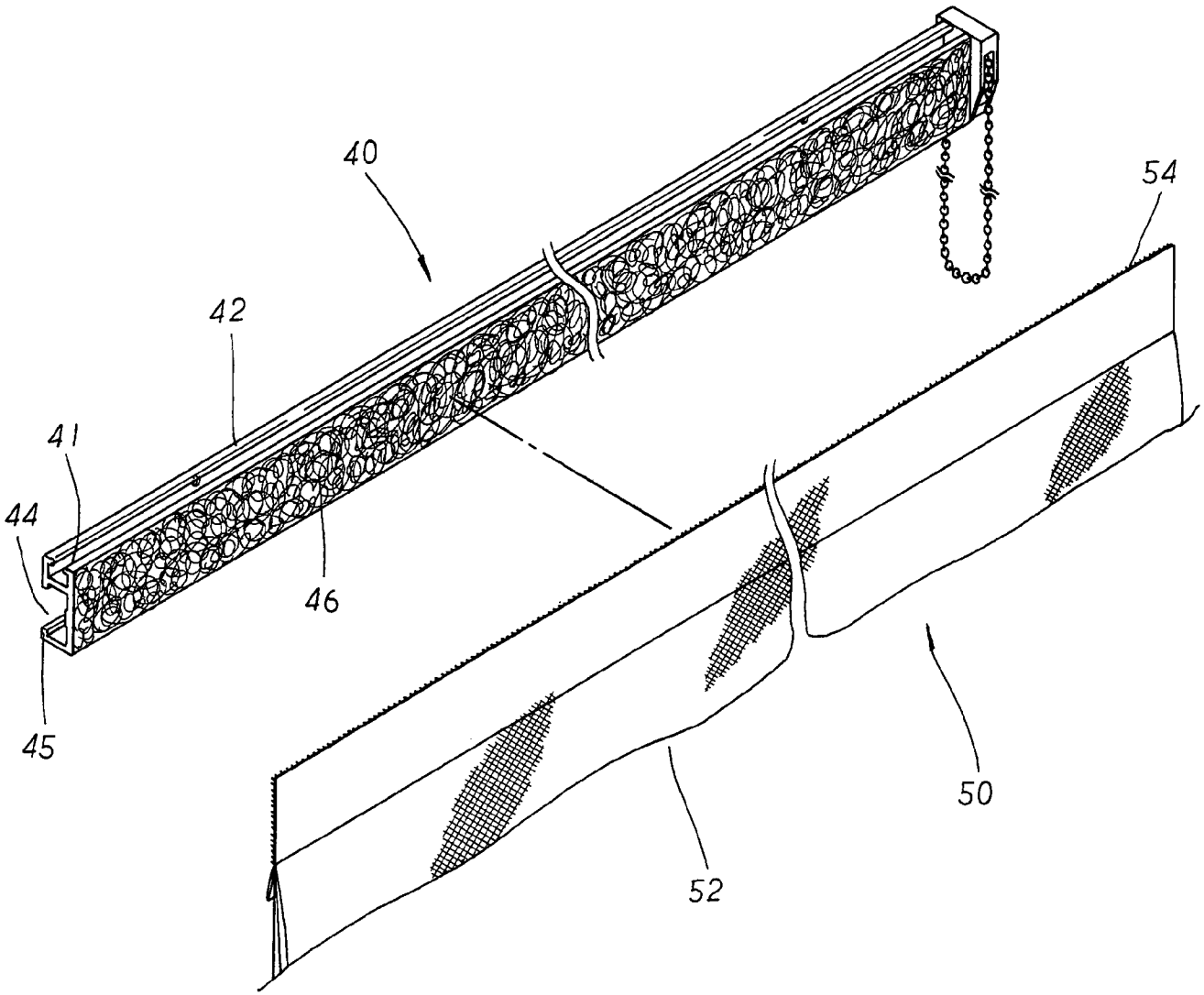
FIG. 3 is another partially exploded and perspective view of the present invention.
Figure 4:
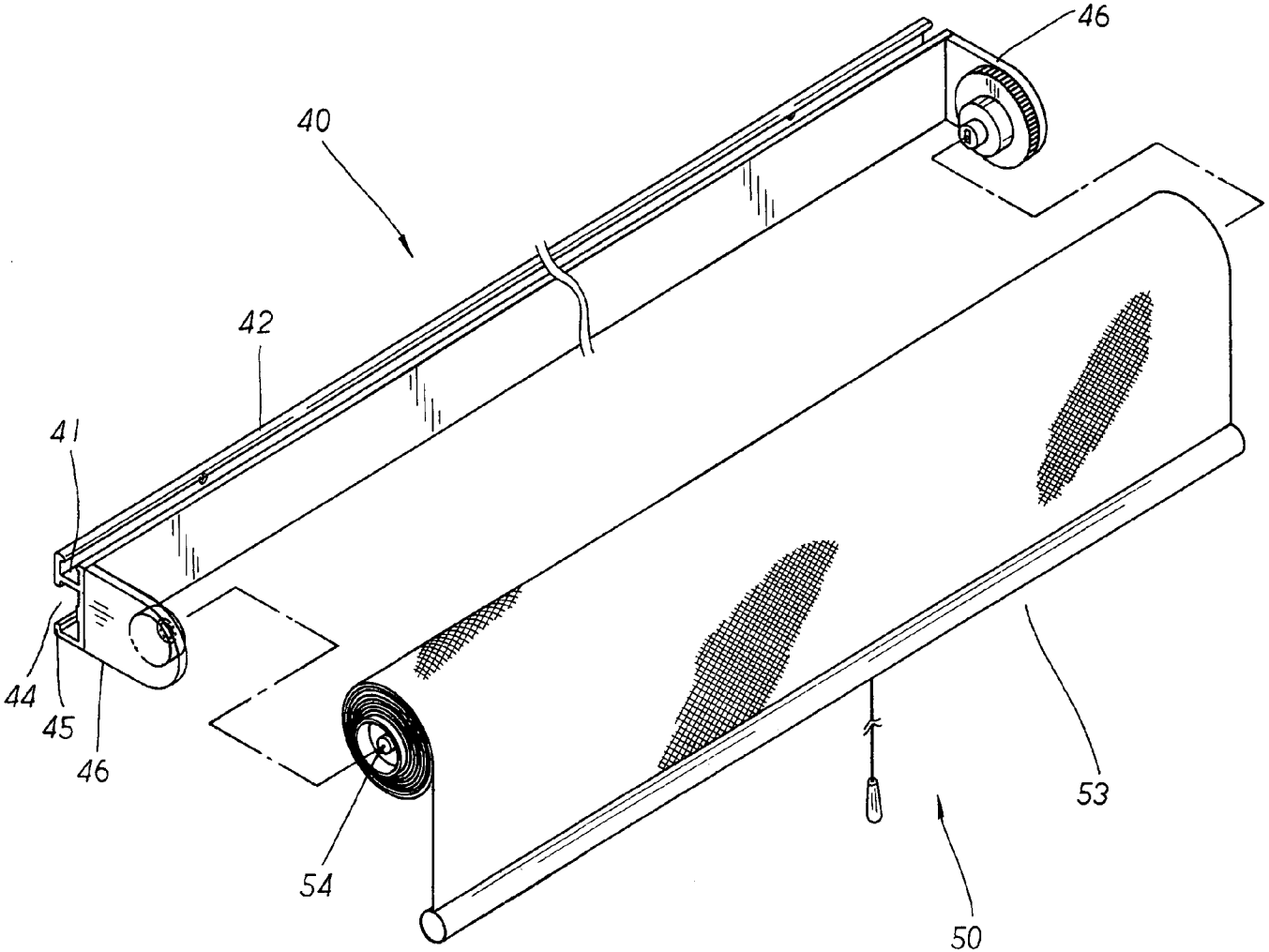
FIG. 4 is a third partially exploded and perspective view of the present invention.

Please refer to FIG. 2. The present invention is related to a window blind structure with multiple rods and blinds, including a plurality of support brackets 20, hook elements 30, head rails 40, and blind bodies 50. Each support bracket 20, made in a T shape, is equipped with a fixing end 21 with multiple fixing thru-holes 23 disposed thereon for the securing engagement of locking screws 23 therewith, and a suspending arm 24 properly extending forwards from the fixing end 21 thereof and provided with a plurality of equally-spaced retaining members 26 each surrounded by a retaining space 27 and equipped with a curved retaining surface for the location of a matched hanging rod 25 thereon. Both sides of each retaining member 26 are defined by a set of left/right movement spaces 28, 29 to respectively match with a hooked head portion 31 and an arcuate protrusive portion 32 of the hook member 30 thereby. The hanging rod 25 thereof is made of a rounded rod body of an appropriate length, and the hook element 30, having a cross-sectional configuration of a question mark (?), is provided with a hooked hanging portion 33 defined by a hanging space 34 therein to match with the hanging rod 25 for location thereon, an inserting block 35 disposed at the bottom end thereof, and a pair of indented recesses 36 symmetrically cut at both lateral sides of the inserting block 35 thereof. At the upper section of the head rail 40 is disposed an inserting groove 41 limited by a set of laterally-extending flanges 42, with which the inserting block 35 of the hook element 30 is engaged and securely locked thereto via a fixing member 43. And, at the lower section of the head rail 40 is disposed a receiving space 44 defined by a stop flange 45 vertically extending at one side thereof. The head rail 40 also includes a connecting portion 46 disposed at a predetermined section thereon for the attachment thereto of a connected portion 54 (like a fastened element of a Velcro strip) of a blind body 50 (of different types such as a lift-cord Roman blind 51 as shown in FIG. 2, or a beaded-cord Roman blind 52 of FIG. 3, etc.) wherein the connecting portion 46 of the head rail 40 (like a fastening element of a Velcro strip as shown in FIGS. 2, 3) can be disposed at one lateral side surface thereon, or (like a linkage positioning device) mounted at the outer side of both ends thereof respectively for the engagement of the connected portion 54 (said a shaft) of a spring-loaded roller blind 53 as shown in FIG. 4 thereby.

Figure 5:
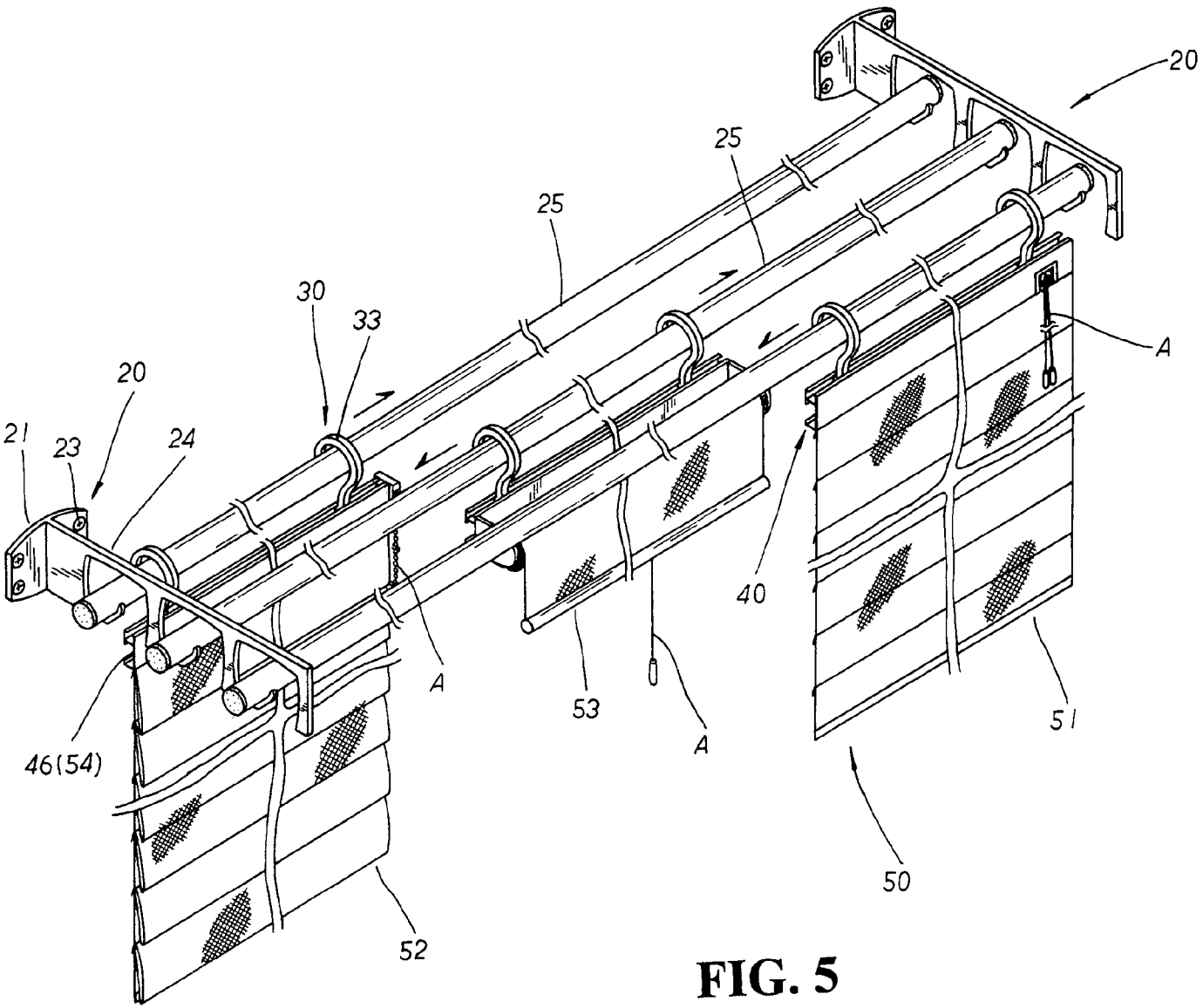
FIG. 5 is an exploded perspective view of the present invention in operation thereof.
Figure 6:
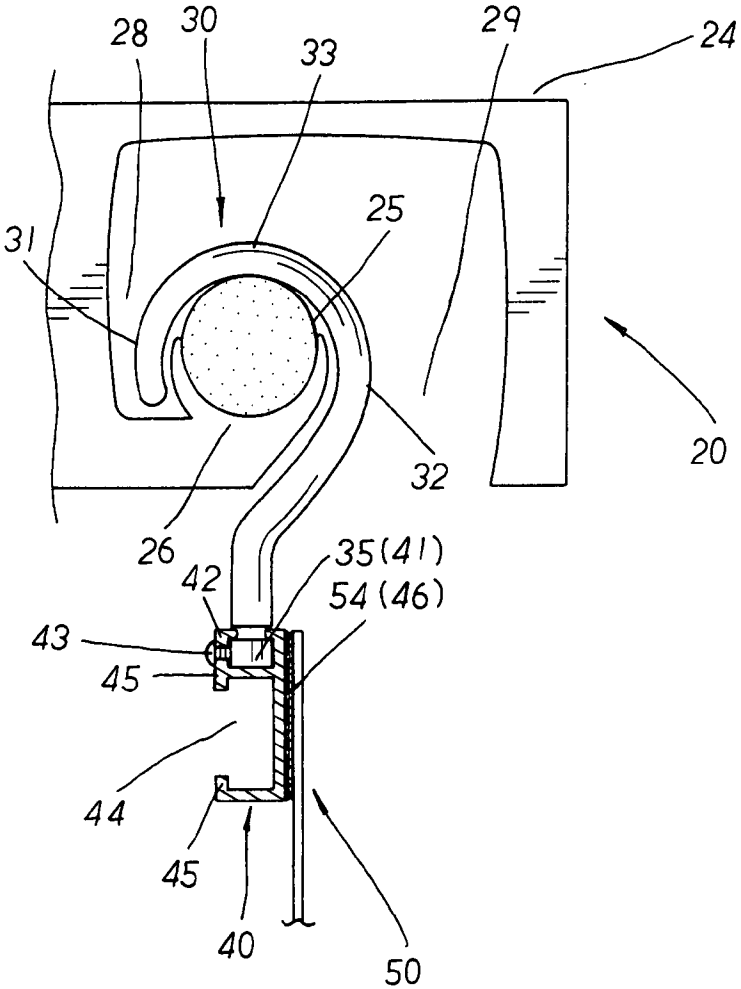
FIG. 6 is a partially cross-sectional and assembled view of the present invention.

Please refer to FIG. 5. In assembly, the fixing ends 21 of more than one support brackets 20 are stably located via the locking screws 23 led through the thru-holes 22 for secure fixing thereof. Then, a plurality of the hanging rods are respectively accommodated into the retaining spaces 27 and placed onto the matched retaining members 26 of the suspending arms 24 thereof, and the connected portions 54 of the different blind bodies 50 such as the lift-cord Roman blind 51, the beaded-cord Roman blind 52, and the spring-loaded roller blind 53 are respectively applied to attach to the connecting portions 46 of multiple head rails 40 thereof. A plurality of the hook elements 30 are respectively mounted to the head rails 40 thereof with the inserting block 35 of each hook element 30 adapted to an appropriate position at the interior of the inserting groove 41 and the indented recesses 36 thereof and precisely engaged with the lateral-extending flanges 42 of each head rail 40 before the hook element 30 is securely locked via the fixing member 43 at a predetermined position of the head rail 40. Then, more than one various types of the blind bodies 50 like the lift-cord Roman blind 51, the beaded-cord Roman blind 52, and the spring-loaded roller blind 53 respectively fastened to the head rails 40 thereof are mounted to the hanging rods 25 and suspended downwards there-from via the hook elements 30 whose hanging spaces 34 are guided from both ends of the hanging rods 25 thereof to hook the hanging portions 33 onto the hanging rods 25 thereby. And, via the matched left/right movement spaces 28, 29 of the suspending arm 24 thereof, the hook element 30 can be transversely moved at the hanging rod 25 thereon without the hooked head portion 31 and the arcuate protrusive portion 32 disposed at both sides thereof being hindered by the retaining member 26 as shown in FIG. 6. Therefore, depending on the needs of a user, different types of the blind bodies 50 can be freely moved and alternatively arranged at the hanging rods 25 of the support brackets 20 thereon via the hook elements 30 thereof, providing versatile and interesting variation thereof to boost the beauty of the window blinds thereof as a whole. And, the blind bodies 50 can also be easily and speedily replaced with new ones of different styles as desired, facilitating a more flexible application of the present invention in practical use. Moreover, via the hook elements 30 with the inserting blocks 35 accommodated into the inserting grooves 41 of the head rails 40 and securely locked thereto by the fixing members 43, the head rails 40 are stably held in place on the hanging rods 25 of the support brackets 20 so that pull cords A of the different blind bodies 50 (like the lift-cord Roman blind 51, the beaded-cord Roman blind 52, and the spring-loaded roller blind 53 can be smoothly manipulated to control the collecting and expanding operation of the blind bodies 50, achieving a more convenient application thereof.

Figure 7:
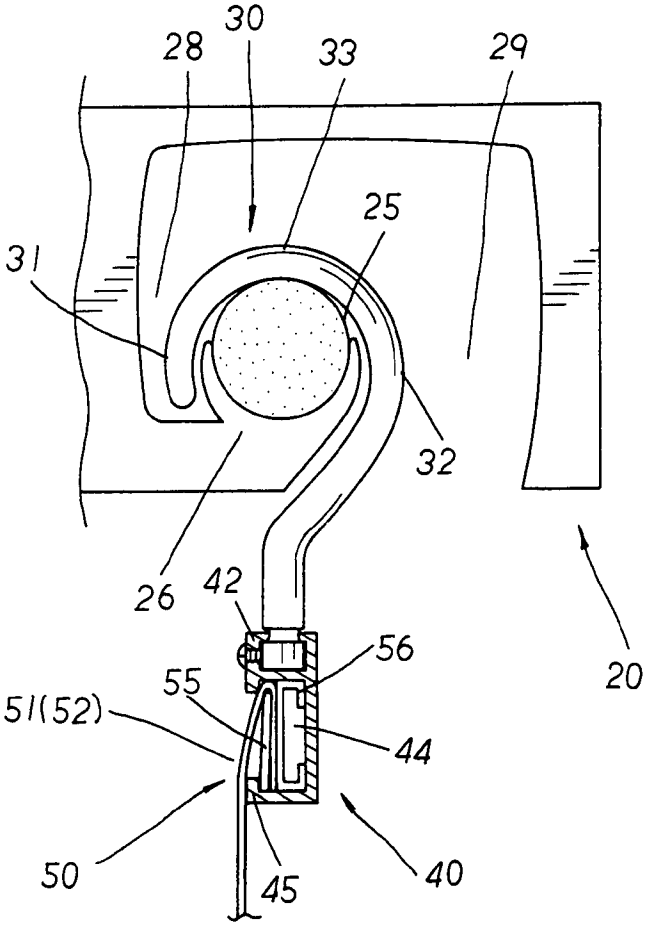
FIG. 7 is a partially cross-sectional and assembled view of another embodiment of the present invention.

Please refer to FIG. 7 showing another embodiment of the present invention. The present invention can also comprise different types of blind bodies 50 such as a lift-cord Roman blind 51, and a beaded-cord Roman blind 52 wherein each blind body 50 is clamped tight from both sides by an abutting plate 55 and a support member 56 to be mounted to the receiving space 44 of the head rail 40 and limited by the stop flange 45 therein for secure location thereby.

What is claimed is:

1. A window blind structure with multiple rods and blinds, including a plurality of support brackets, hook elements, head rails, and blind bodies wherein each support bracket is equipped with a fixing end with multiple fixing thru-holes disposed thereon for the securing engagement of locking screws therewith, and a suspending arm properly extending forwards from the fixing end thereof and provided with a plurality of equally-spaced retaining members each surrounded by a retaining space for the location of a matched hanging rod thereon; both sides of each retaining member are defined by a set of left/right movement spaces to match with a hooked head portion and an arcuate protrusive portion of the hook element thereby, and the hook element is provided with a hooked-hanging portion defined by a hanging space therein to match with the hanging rod for the location thereon; at the bottom end of the hook element is disposed an inserting block with a pair of indented recesses symmetrically cut at both lateral sides thereof; at the upper section of the head rail is disposed an inserting groove limited by a set of laterally-extending flanges, and at the lower section of the head rail is disposed a receiving space defined by a stop flange vertically extending at one side thereof; besides, the head rail also includes a connecting portion disposed at a predetermined section thereon for the attachment thereto of a connected portion of the blind body of different types; via the aforementioned structure, the blind bodies of different types are respectively mounted to the head rails via the connected portions thereof securely fastened to the connecting portion of the head rails for location thereby, and the hook elements, whose inserting blocks are respectively accommodated into the inserting grooves of the head rail and securely locked thereto by fixing members, are stably hooked onto the hanging rods of the support brackets thereof, permitting the blind bodies of different types to be freely moved and alternatively arranged at the hanging rods of the support brackets thereon according to the needs of a user, providing versatile and interesting variation thereof for more beautiful display of the window blinds thereof as a whole; besides, the blind bodies can also be easily and speedily replaced with new ones of different styles as desired, facilitating a more flexible application of the present invention in practical use.

2. The window blind structure with multiple rods and blinds as claimed in claim 1 wherein the support bracket is made in a T shape.

3. The window blind structure with multiple rods and blinds as claimed in claim 1 wherein each retaining member of the support bracket is equipped with a curved retaining surface.

4. The window blind structure with multiple rods and blinds as claimed in claim 1 wherein each hanging rod is made of a rounded rod body of an appropriate length.

5. The window blind structure with multiple rods and blinds as claimed in claim 1 wherein each hook element has a cross-sectional configuration of a question mark (?).

6. The window blind structure with multiple rods and blinds as claimed in claim 1 wherein the connecting portions of the head rails can be made up of a fastening element of a Velcro strip, and a linkage positioning device.

7. The window blind structure with multiple rods and blinds as claimed in claim 1 wherein the blind bodies of different types can be a lift-cord Roman blind, a beaded-cord Roman blind, and a spring-loaded roller blind.

8. The window blind structure with multiple rods and blinds as claimed in claim 1 wherein the connected portions of the blind bodies can be made up of a fastened element of a Velcro strip, and a shaft.

9. The window blind structure with multiple rods and blinds as claimed in claim 1 wherein the connecting portion of the head rail can be disposed at one lateral side surface thereon.

10. The window blind structure with multiple rods and blinds as claimed in claim 1 wherein the connecting portion of the head rail can also be disposed at the outer side of both ends thereof.

11. The window blind structure with multiple rods and blinds as claimed in claim 1 wherein the head rail has a fixing member applied thereto to securely lock the hook element onto the head rail thereby.

12. The window blind structure with multiple rods and blinds as claimed in claim 1 wherein the hanging rods of the support brackets can have more than one blind bodies of different types mounted thereon to suspend downwards there-from.

13. The window blind structure with multiple rods and blinds as claimed in claim 1 wherein the upper edge of the blind body can be clamped tight from both sides by an abutting plate and a support member to be mounted to the receiving space of the head rail and limited by the stop flange therein for secure location thereby.

* * * * *